US008342061B2

(12) United States Patent
Super

(10) Patent No.: US 8,342,061 B2
(45) Date of Patent: Jan. 1, 2013

(54) WRENCH ADAPTER

(75) Inventor: Orion J. Super, Miramar, FL (US)

(73) Assignee: Sunex International, Inc., Travelers Rest, SC (US)

( * ) Notice: Subject to any disclaimer, the term of this patent is extended or adjusted under 35 U.S.C. 154(b) by 161 days.

(21) Appl. No.: 12/541,717

(22) Filed: Aug. 14, 2009

(65) Prior Publication Data

US 2010/0326249 A1 Dec. 30, 2010

(51) Int. Cl.
*B25B 23/00* (2006.01)

(52) U.S. Cl. ..... 81/177.85

(58) Field of Classification Search ..... 81/177.85, 81/60, 119, 124.3, 124.6, 124.7; D8/27, D8/29, 70; D15/140; 279/143, 144
See application file for complete search history.

(56) References Cited

U.S. PATENT DOCUMENTS 886,476 A * 5/1908 Burnop ..... 81/177.85
4,004,476 A 1/1977 DeVrou
D245,395 S * 8/1977 Cognevich ..... D8/70
D250,167 S 11/1978 D'Oporic
4,750,750 A 6/1988 Batalorf
5,038,869 A * 8/1991 Olson ..... 81/177.85
D335,071 S 4/1993 Fine
D347,983 S 6/1994 Lee
D359,669 S 6/1995 Splingaire
5,438,894 A 8/1995 Pearce
5,448,930 A 9/1995 Miner et al.
5,568,757 A 10/1996 Lewis
5,595,099 A * 1/1997 Pusateri ..... 81/177.85
5,626,062 A 5/1997 Colvin
5,819,606 A 10/1998 Arnold
D425,770 S 5/2000 Hsieh
6,550,358 B1 4/2003 Martin
6,601,477 B2 8/2003 Huang
6,626,067 B1 * 9/2003 Iwinski et al. ..... 81/121.1
6,823,762 B2 11/2004 Hu
D500,436 S 1/2005 Chen
6,901,827 B1 6/2005 Yen
7,036,406 B2 * 5/2006 Milbourne et al. ..... 81/177.85
D526,547 S 8/2006 Houpe
7,185,568 B1 3/2007 Vance
7,207,393 B2 4/2007 Clark et al.
7,249,638 B2 7/2007 Bodine et al.
D567,605 S 4/2008 Yu
7,398,711 B1 7/2008 Liu
D600,521 S * 9/2009 Butler ..... D8/29
2006/0175773 A1 * 8/2006 Tsai et al. ..... 279/143
2007/0044600 A1 3/2007 Chen
2008/0047402 A1 2/2008 Lin

* cited by examiner

*Primary Examiner* — Hadi Shakeri
(74) *Attorney, Agent, or Firm* — J. Bennett Mullinax, LLC

(57) ABSTRACT

A wrench adapter is provided that includes a body that has a base member with a bottom surface and a top surface. The body has a square shaped male drive with a side wall surface. The body has a concave transition surface with an upper end that is flush with the side wall surface so that a smooth transition is present from the side wall surface of the male drive to the concave transition surface across the upper end of the concave transition surface.

20 Claims, 7 Drawing Sheets

WRENCH ADAPTER

FIELD OF THE INVENTION

The present invention relates generally to an adapter for use with a wrench. More particularly, the present application involves an impact wrench adapter that has a transition between the male drive and the body that is configured to increase the strength of the wrench adapter.

BACKGROUND

Wrenches are fastening tools that are used to tighten and loosen various types of fittings such as bolts and nuts. Wrenches typically employ a square shaped male drive that is attached to complimentary female shaped drives of removable sockets. Sockets of appropriate sizes and configurations are placed onto the desired fitting and the wrench can be rotated, for example by hand, so that the socket in turn applies torque to the fitting to effect its loosening or tightening. The wrench is provided with a ratcheting mechanism that allows the wrench to be turned without having to lift the device off of the fitting that is being tightened or loosened. Wrenches are usually reversible by way of an internal mechanism that can be actuated in order to switch between tightening and loosening while the wrench is turned in the same direction.

Impact wrenches are known for use in high torque applications such as product assembly, vehicle servicing, heavy equipment repair, and building construction. Impact wrenches may be pneumatically, hydraulically or electrically driven and can be generally linear in shape or may resemble a pistol in other variations. Impact wrenches typically have a square male drive to which a socket may be attached that can be subsequently fit onto the fitting that is to be secured or loosened. The socket may be attached to the square male drive by way of a spring-loaded pin in the square male drive that is received within a complimentary recess of the socket. Alternatively, a hog ring arrangement can be used to hold the socket onto the square male drive, or a pin can be employed to secure the socket to the square male drive. The user can actuate the impact wrench by pressing a button which causes a high torque impact to be imparted onto the socket and fitting.

Adapters are often used to allow wrenches that have a square male drive of a certain size to be used with sockets that have a differently sized female drive. Adapters include a female drive fitting that accepts the male drive of the wrench and a male drive fitting that accepts the female drive of the socket. Adapters for use with hand wrenches are made of a strong steel while adapters for use with impact wrenches are typically made of a more malleable steel. Weaker steel is used in impact adapters since high tightening forces are present. In this regard it is desired to have an adapter that is overstressed flex and then tear apart instead of being shattered and potentially causing injury to the user. Since impact adapters are made of weaker materials they may fail during use thus wasting time and increasing cost of use of the impact wrench.

FIGS. 1 and 2 illustrate a wrench adapter 100 that has a curved flange 102 that terminates at four planar ledges 104 located adjacent the sides of a male drive 108 of the wrench adapter 100. The planar ledges 104 are oriented so that they each have a planar normal that extends parallel to the longitudinal axis 106 of the wrench adapter 100. Insertion of the male drive 108 into a complimentary female drive of a socket and subsequent turning of the wrench adapter 100 by an impact wrench or the like results in the application of force to the curved flange 102 and the planar ledges 104. The arrangement of the male drive 108 and the planar ledges 104 causes a stress concentration to be realized that results in fracture of the wrench adapter 100 and ultimate failure. As such, there remains room for variation and improvement in the art.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended Figs. in which.

Figure 1:
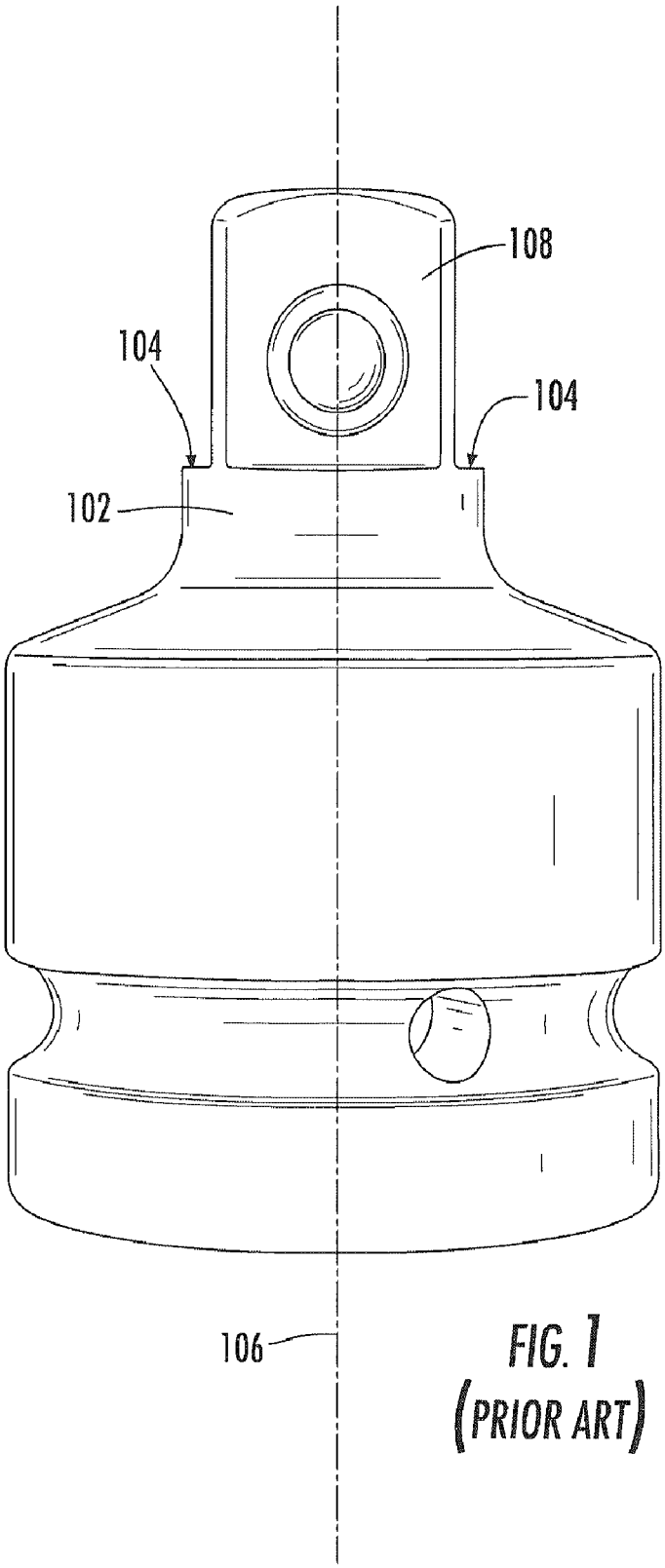
FIG. 1 (PRIOR ART)
FIG. 1 is a side view of a prior wrench adapter.
Figure 2:
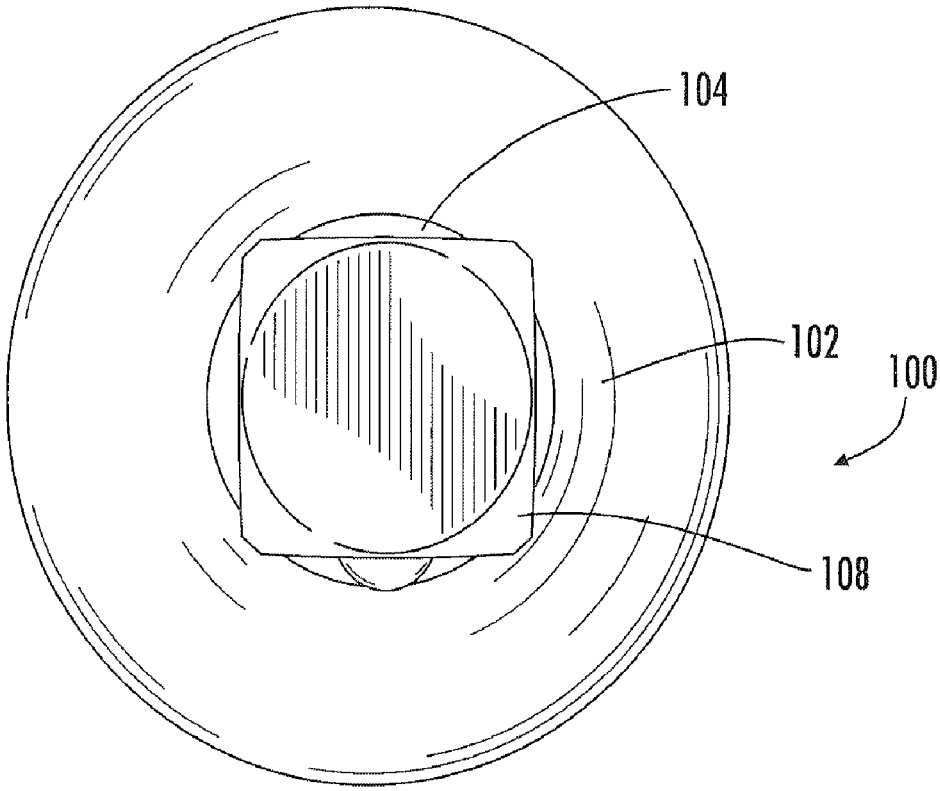
FIG. 2 (PRIOR ART)
FIG. 2 is a top view of the prior wrench adapter of FIG. 1.

Repeat use of reference characters in the present specification and drawings is intended to represent the same or analogous features or elements of the invention.

DETAILED DESCRIPTION OF REPRESENTATIVE EMBODIMENTS

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to 7 also includes a limit of up to 5, up to 3, and up to 4.5.

The present invention provides for a wrench adapter 10 that can be used to allow wrenches of particular sizes to be used with sockets of different sizes. For example, the wrench adapter 10 may be configured to allow a wrench with a square male fitting that is three fourths of an inch to be used with a socket that has a female drive that is one half of an inch. The wrench adapter 10 may include a body 12 that includes both a base member 14 and a male drive 30. The body 12 may be arranged so that a transition between the base member 14 and the male drive 30 is realized that minimizes stress concentrations. The wrench adapter 10 thus enjoys a longer life and can be used with higher torsion applications.

Figure 3:
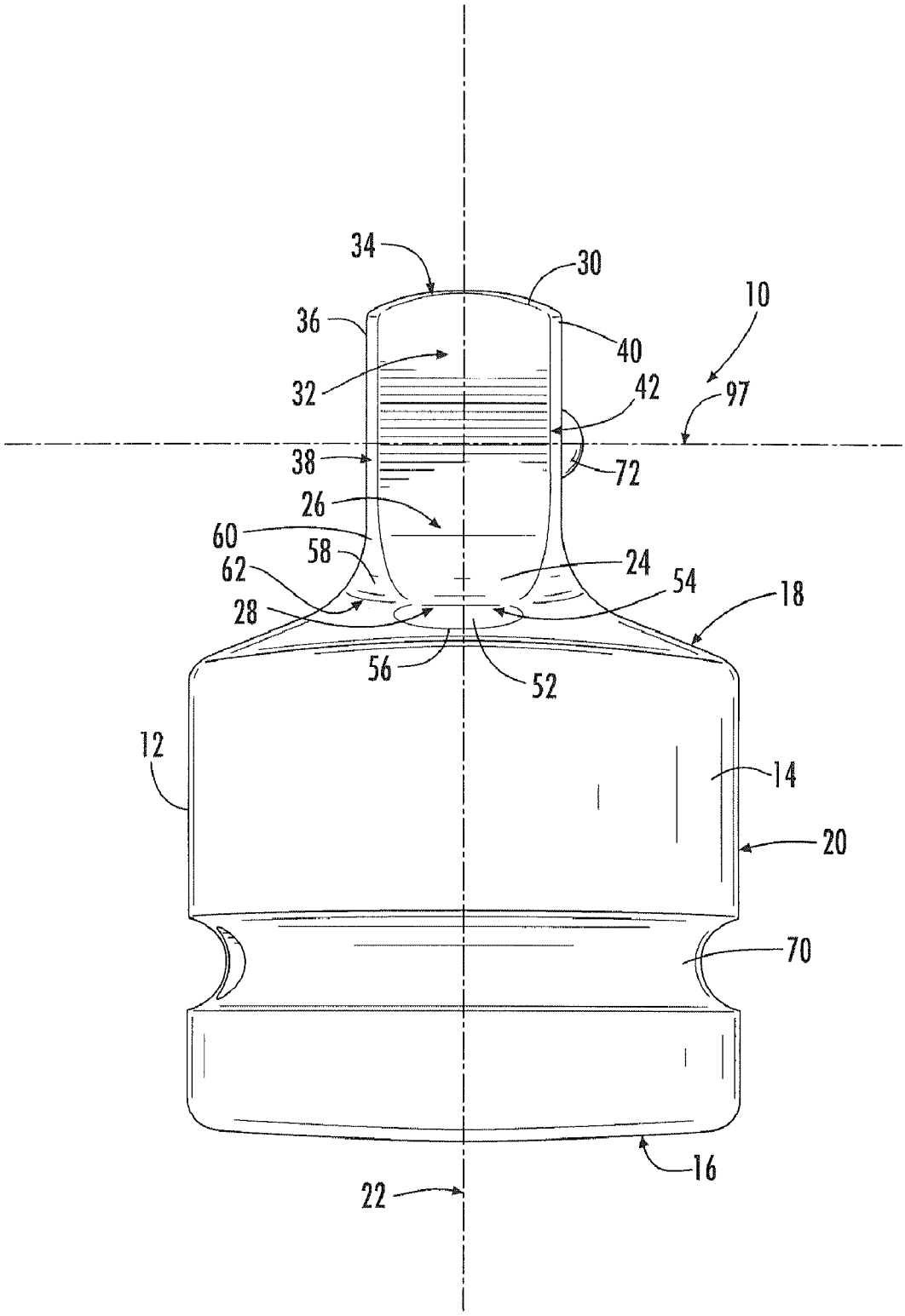
FIG. 3 is a side view of a wrench adapter in accordance with one exemplary embodiment.

FIG. 3 shows one exemplary embodiment of the wrench adapter 10. The wrench adapter 10 includes a body 12 that may be integrally formed in accordance with certain exemplary embodiments. In other arrangements, the body 12 may include components that are attached to one another through welding, soldering or mechanical fasteners. The body 12 may be made of chrome vanadium steel in accordance with certain exemplary embodiments. In accordance with other exemplary embodiments, the body 12 may be made of chrome molybdenum steel or may be made of chrome vanadium steel. It is to be understood that the body 12 may be made out of a variety of other materials or combination of materials in accordance with other exemplary embodiments.

The body 12 includes a base member 14 that has a bottom surface 16 and an oppositely disposed top surface 18. A side wall 20 extends from the bottom surface 16 to the top surface 18 and is curved so as to be generally convex in shape. However, the side wall 20 may be generally flat in accordance with other exemplary embodiments. The body 12 also has a male drive 30 that extends in the longitudinal direction. As shown, the male drive 30 is square shaped so as to be used in combination with sockets that have female drive fittings. The male drive 30 need not be square shaped in other arrangements of the wrench adapter 10 and can be variously shaped.

The male drive 30 has a side wall surface 32 that is planar. The side wall surface 32 may be completely planar or may have curved portions in accordance with various exemplary embodiments. The male drive 30 includes a pair of corners 36 and 40 that are located on opposite sides of the side wall surface 32. The corners 36 and 40 have planar corner surfaces 38 and 42. The planar side wall surface 32 thus extends between the planar corner surfaces 38 and 42. The corners 36 and 40 need not have planar surfaces in other arrangements of the wrench adapter 10. For example, the corners 36 and 40 may have surfaces that are concave or convex or may be formed as edges that do not have a planar portion. The male drive 30 has a top surface 34 that has a planar portion with a planar normal that is parallel to the longitudinal axis 22.

Body 12 includes a concave transition surface 24 that is concave in shape and that has an upper end 26 that engages the side wall surface 32. Engagement between the side wall surface 32 and the concave transition surface 24 may be arranged so that a smooth transition is formed from the side wall surface 32 across the upper end 26 to the concave transition surface 24. As such, the upper end 26 may not be a ledge or other projection that causes a stress concentration. The smooth transition between the side wall surface 32 and the concave transition surface 24 may be realized such that a projection is not present between these two elements. The upper end 26 may be identified as the portion of the body 12 that starts to demonstrate a concave feature as moving across the planar side wall surface 32 to the concave transition surface 24. The concave transition surface 24 may have a constant radius of curvature. Alternatively, the concave transition surface 24 may be composed of multiple surfaces that have different radiuses of curvature. The concave transition surface 24 may be arranged so that its width decreases in the direction extending away from the male drive 30.

The body 12 includes a corner transition surface 58 that has an upper end 60 that contacts the planar corner surface 38 of the corner 36. The corner transition surface 58 may have a surface that is concave in shape that has a radius of curvature that is different from the radius of curvature of the concave transition surface 24. A ridge may thus be formed between the corner transition surface 58 and the concave transition surface 24. However, it is to be understood that the corner transition surface 58 and the concave transition surface 24 may each have a radius of curvature that is identical in other arrangements of the wrench adapter 10. The transition from the planar corner surface 38 to the corner transition surface 58 across the upper end 60 may be a smooth transition such that a projection or ledge is not present at the upper end 60. The upper end 60 may thus be identified as the portion of the body 12 in which the planar corner surface 38 begins to establish a concave shape as extending in the direction away from the male drive 30. The corner transition surface 58 extends on the body 12 and has a lower end 62. The transition between the corner transition surface 58 and the top surface 18 of the base member 14 across the lower end 62 is not smooth in accordance with certain exemplary embodiments. In this regard, the lower end 62 may include a ridge, projection or may be depressed such that a noticeable change in the surface of the body 12 is evident. In accordance with one exemplary embodiment, the corner transition surface 58 has a radius of curvature while the top surface 18 does not have a radius of curvature. In this regard, the top surface 18 may extend towards the longitudinal axis 22 in the direction from the side wall 20 towards the corner transition surface 58 without being curved in a shape that is neither concave or convex.

The body 12 may also include a recess surface 52 in accordance with certain exemplary embodiments. Recess surface 52 may be present on the body 12 so that it is located below the top surface 18 of the base member 14. In this regard, a smooth transition is not present from the recess surface 52 to the top surface 18 across the lower end 56 of the recess surface 52. A ridge or other projection may be present at the lower end 56 so that a noticeable change in the surface of body 12 is evident between the recess surface 52 and the top surface 18. The recess surface 52 may be planar or may be concave in accordance with certain exemplary embodiments. The recess surface 52 may be provided so that a smooth transition is present from the concave transition surface 24 to the recess surface 52 across the upper end 54 of the recess surface 52. In this regard, projections or ridges are not present at the upper end 54 of the recess surface 52. The recess surface 52 may have a radius of curvature, or may not have a radius of curvature at all, that is different from the radius of curvature of the concave transition surface 24. The recess surface 52 may initially become wider upon extending from the upper end 54 away from the concave transition surface 24. However, the width of the recess surface 52 may then narrow upon further extension away from the concave transition surface 24. The upper end 54 of the recess surface 52 may coincide with the bottom end 28 of the concave transition surface 24 so that they are at the same location.

The top surface 18 of the base member 14 extends towards the longitudinal axis 22 in the direction from an upper edge 98 of the side wall 20 towards the male drive 30. The top surface 18 may be convex in accordance with certain exemplary embodiments or flat but frusto-conical in shape such that the top surface 18 is generally flat but extends in the longitudinal direction. The body 12 can be arranged so that none of the surfaces of the body 12 located between the upper edge 98 and the longitudinal midpoint 97 of the male drive 30 have a planar normal that is parallel to the longitudinal axis 22. In this regard, all of the surface between these two locations may have a planar normal that extends at least some in the radial direction and thus not completely in a direction parallel to the longitudinal axis 22. Further, the body 12 may be provided so that all of the surfaces of the body 12 that engage the male drive 30 are concave in shape. However, it is to be understood that other versions of the wrench adapter 10 are possible in which the aforementioned configurations do not exist.

Figure 4:
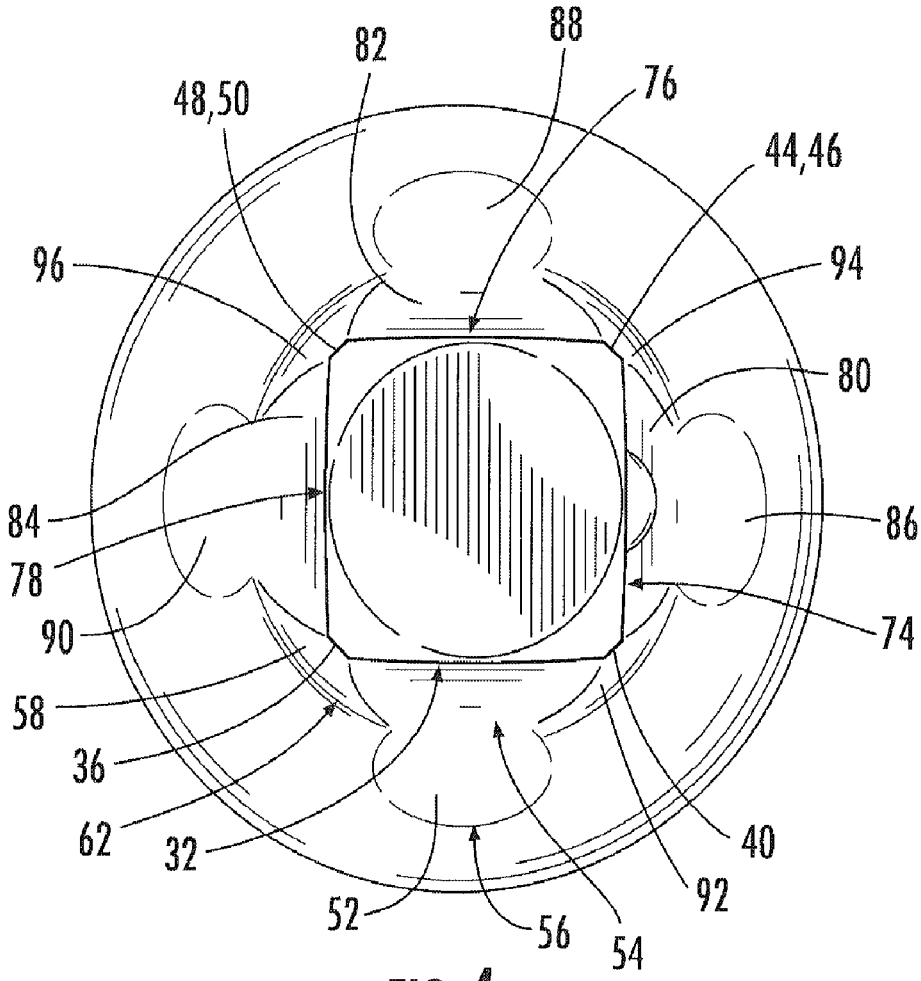
FIG. 4 is a top view of the wrench adapter of FIG. 3.
Figure 5:
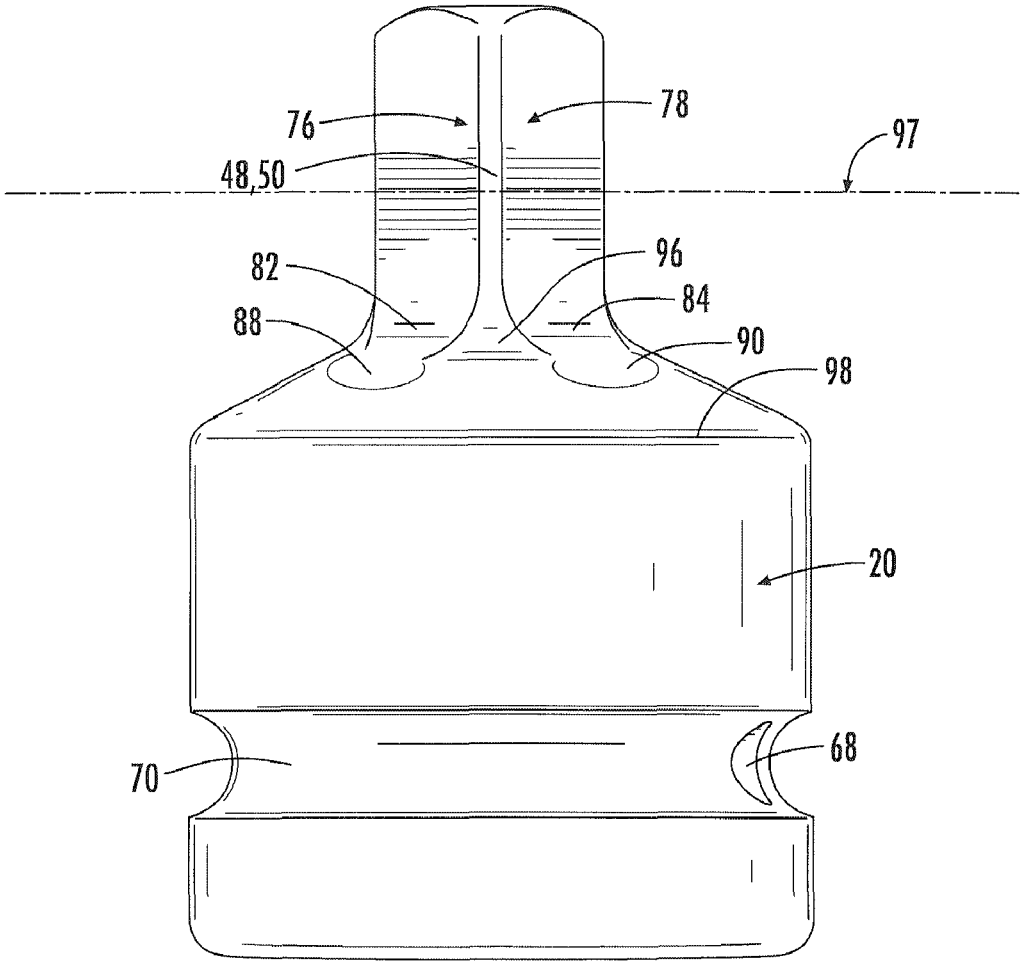
FIG. 5 is a side view of the wrench adapter of FIG. 3 rotated from the position shown in FIG. 3 about the longitudinal axis.
Figure 6:
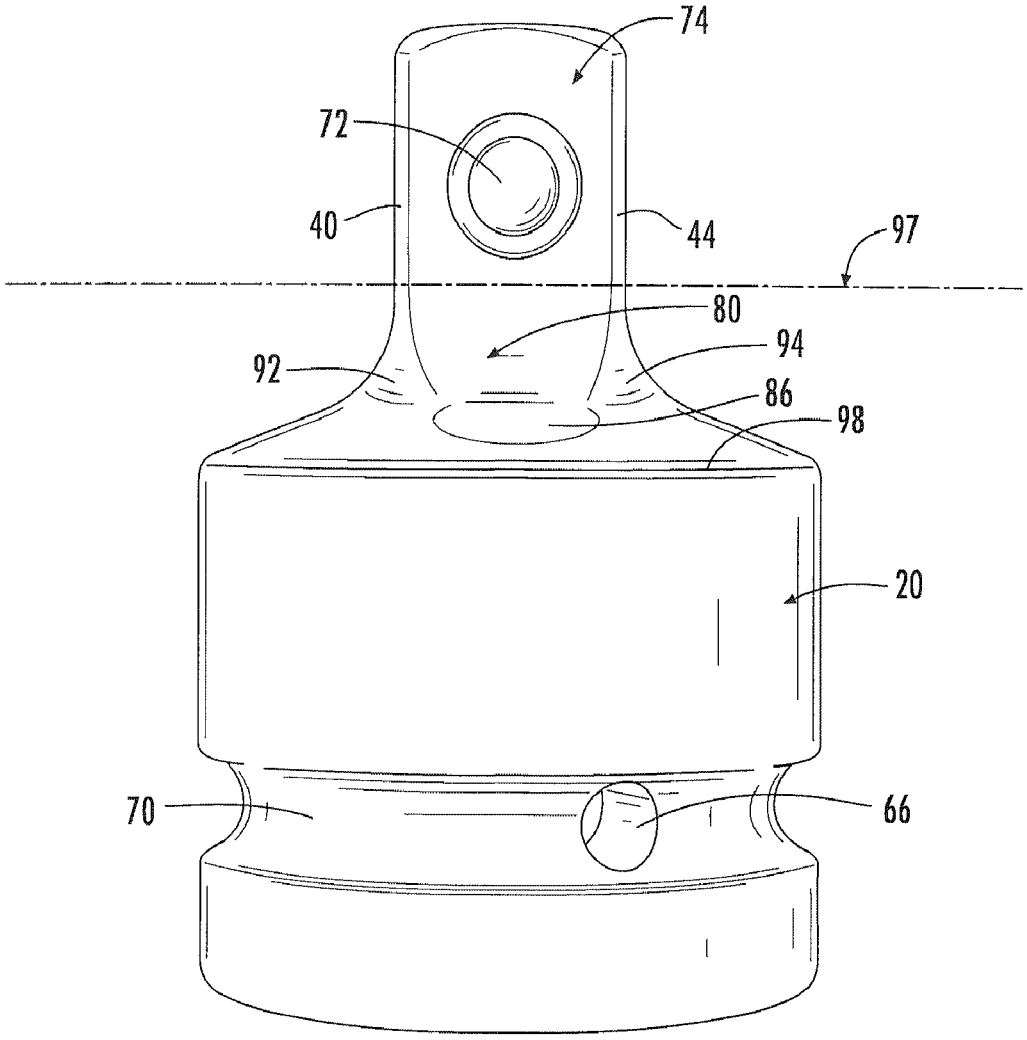
FIG. 6 is a side view of the wrench adapter of FIG. 3 rotated from the position shown in both FIGS. 3 and 5 about the longitudinal axis.

As disclosed, the wrench adapter 10 is generally symmetrical. In this regard, reference is made to FIGS. 4-6 that illustrate additional features of the wrench adapter 10. The male drive 30 has a corner 44 with a planar corner surface 46, and an additional corner 48 with a planar corner surface 50. A second side wall surface 74, a third side wall surface 76 and a fourth side wall surface 78 are disposed between the corners 40, 44 and 48. The additional side wall surfaces 74, 76 and 78 may be identical to one another or different in accordance with different exemplary embodiments. Further, the additional side wall surfaces 74, 76 and 78 may be provided in a manner similar to side wall surface 32 as previously discussed and a repeat of this information is thus not necessary.

The body 12 can also be provided with a second concave transition surface 80, a third concave transition surface 82 and a fourth concave transition surface 84. The second concave transition surface 80 may engage the second side wall surface 74. In a similar manner, surface 82 may engage surface 76, and surface 84 can engage surface 78. Concave transition surfaces 80, 82 and 84 may be configured in a manner identical to one another or may be different from one another in one or more regards. The additional concave transition surfaces 80, 82 and 84 may be arranged in a manner similar to that previously discussed with respect to concave transition surface 24 and a repeat of this description is not necessary.

Extending from the concave transition surfaces 80, 82 and 84 are second, third and fourth recess surfaces 86, 88 and 90. The second, third and fourth recess surface 86, 88 and 90 may be arranged in an identical manner to one another or may arranged differently from one another in accordance with different exemplary embodiments. The recess surfaces 86, 88 and 90 can be provided in manners identical to those previously mentioned with respect to recess surface 52, and a repeat of this information is thus not necessary. Although described as having recess surfaces 52, 86, 88 and 90, it is to be understood that these surfaces 52, 86, 88 and 90 are not necessary in accordance with various exemplary embodiments of the wrench adapter 10.

Additional corner transition surfaces 92, 94 and 96 may also be present. Second corner transition surface 92 may engage planar corner surface 42, and third corner transition surface 94 may engage planar corner surface 46. The fourth corner transition surface 96 may engage planar corner surface 50. The additional corner transition surfaces 92, 94 and 96 may be arranged in a manner identical to one another or can be arranged differently from one another in accordance with various exemplary embodiments. The additional corner transition surfaces 92, 94 and 96 may be configured in a manner identical to that previously described with respect to corner transition surface 58, and a repeat of this information is thus not necessary.

Figure 7:
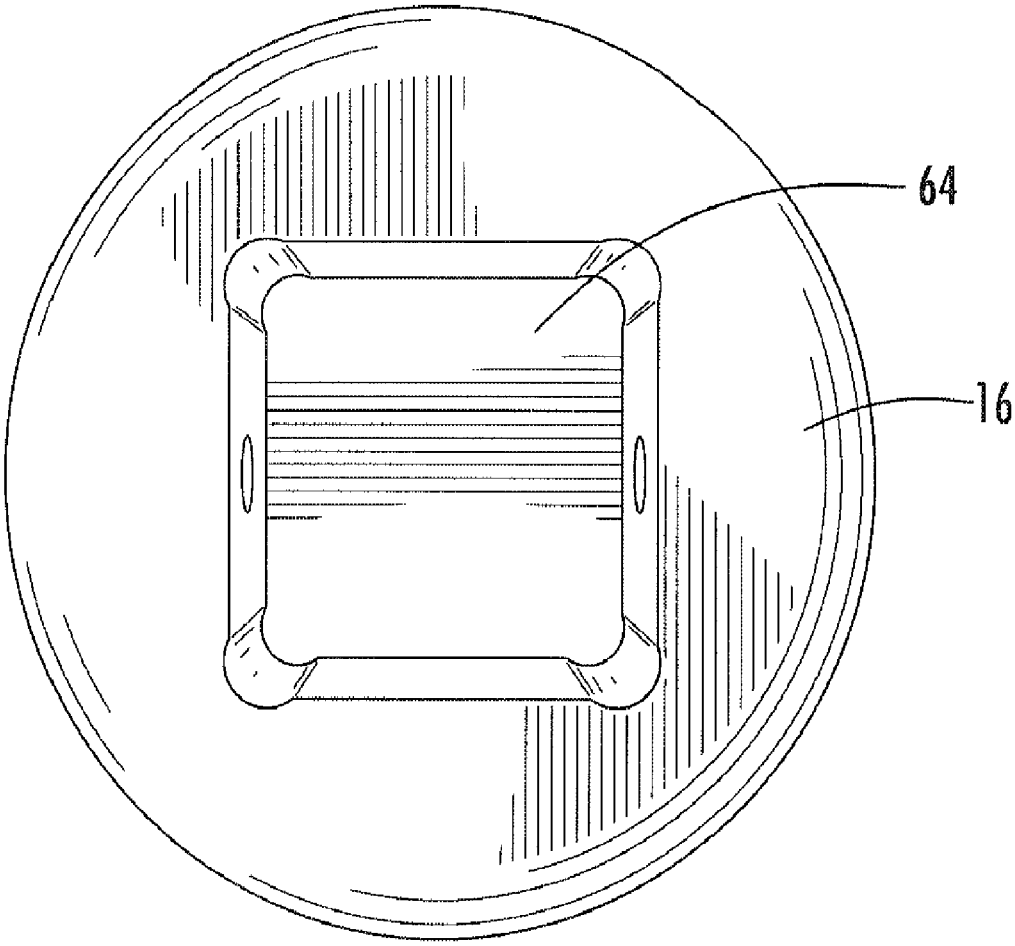
FIG. 7 is a bottom view of the wrench adapter of FIG. 3.

The base member 14 of the wrench adapter 10 may include a female drive 64 that is defined through the bottom surface 16 as shown in FIG. 7. The female drive 64 may be square shaped and can receive a complimentary male fitting from a wrench having a size different than the male drive 30. The corners of the female drive 64 may be rounded in order to reduce the possibility of damage or cracking within the base member 14 due to linear or point contact brought on by edges of the male fitting of the wrench. The female drive 64 need not have rounded corners in other embodiments, and may be triangular, rectangular or hexagonal in shape in other arrangements. The base member 14 is shown as being generally cylindrical in shape. However, the base member 14 can be square or rectangular in shape in other arrangements of the wrench adapter 10.

A groove 70 can be defined completely around the circumference of the base member 14 and may have a U-shaped cross-section as shown generally in FIGS. 3 and 5-7. A pair of aligned radial through holes 66 and 68 may be disposed though the side wall 20 of the base member 14 and can be located in the groove 70. The through holes 66 and 68 can be used in order to attach the wrench adapter 10 to the male fitting of the wrench. In this regard, the male fitting of the wrench can be located inside of the female drive 64 and a pin may be disposed through both of the radial through holes 66 and 68 in order to effect attachment of the wrench adapter 10 to the wrench. However, it is to be understood that other forms of attachment may be used in other embodiments. Further, the male fitting of the wrench can be simply friction fit inside of the female drive 64 in accordance with other exemplary embodiments.

The wrench adapter 10 may include a spring-loaded detent 72 that is carried by the male drive 30. The spring-loaded detent 72 may extend through a portion of the second side wall surface 74 and can be received within a complimentary recess within a female drive of the socket to which the wrench adapter 10 is engaged. It is to be understood that the spring-loaded detent 72 need not be present in other exemplary embodiments and that other mechanisms of attaching the wrench adapter 10 to the socket may be employed. For example, a friction fit engagement, a hog ring, or a pin may be used in accordance with other exemplary embodiments.

Experiments Carried Out in Accordance with Certain Exemplary Embodiments

Experiments were conducted in accordance with certain exemplary embodiments of the wrench adapter 10. In accordance with one experiment, a wrench adapter 100 of current design as disclosed in the drawings and as previously discussed was applied thereto a load 1 which resulted in a maximum stress of $9.59\times10^{9}$ Pa. The same load 1 was then applied to a wrench adapter 10 as disclosed in the drawings and as previously discussed that resulted in a maximum stress of $6.70\times10^{9}$ Pa. The design differences between wrench adapter 100 and wrench adapter 10 upon application of the same load 1 resulted in an approximately 30% decrease in the maximum stress noted. In another experiment, a load 2 was applied to the wrench adapter 100 as disclosed in the drawings and description that resulted in a maximum stress of $1.90\times10^{10}$ Pa. The same load 2 was applied to the wrench adapter 10 as disclosed in the drawings and description that resulted in a maximum stress of $1.30\times10^{10}$ Pa. The design modification between the wrench adapter 10 shown in the drawings and the wrench adapter 100 shown in the drawings resulted in a 30% decrease in the maximum stress imparted thereon when the same load 2 was applied to both wrench adapters 10 and 100.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed:

1. A wrench adapter, comprising:

a body having a base member that has a bottom surface and a top surface, wherein the body has a male drive that is square shaped, wherein the male drive has a side wall surface, wherein the body has a concave transition surface with an upper end that is flush with the side wall surface of the male drive such that a smooth transition is present from the side wall surface of the male drive to the concave transition surface across the upper end of the concave transition surface, wherein the body has a side wall and wherein the side wall has an upper edge;

wherein the body has a recess surface that is defined in the top surface of the base member, wherein the recess surface has a width that increases as the recess surface extends away from the concave transition surface;

wherein the male drive has a corner that has a corner surface, wherein the body has a corner transition surface with an upper end that is flush with the corner surface such that a smooth transition is present from the corner surface to the corner transition surface across the upper end of the corner transition surface;

wherein the lower end of the corner transition surface is not flush with the top surface of the base member such that a smooth transition is not present from the corner transition surface to the top surface of the base member across the lower end of the corner transition surface, and wherein the lower end of the corner transition surface is spaced from the upper edge of the side wall.

2. The wrench adapter as set forth in claim 1, wherein the concave transition surface decreases in width in the direction extending away from the side wall surface of the male drive.

3. The wrench adapter as set forth in claim 1, wherein an upper end of the recess surface is flush with a bottom end of the concave transition surface such that a smooth transition is present from the concave transition surface to the recess surface across the upper end of the recess surface, and wherein a lower end of the recess surface is not flush with the top surface of the base member such that a smooth transition is not present from the recess surface to the top surface of the base member across the lower end of the recess surface;

wherein the width of the recess surface reaches a maximum width location and then narrows as the recess surface extends away from the maximum width location in the direction away from the concave transition surface.

4. The wrench adapter as set forth in claim 1, wherein the corner surface is a planar surface.

5. The wrench adapter as set forth in claim 1, wherein the top surface of the base member extends towards a longitudinal axis in the direction from the side wall of the base member towards the male drive.

6. The wrench adapter as set forth in claim 1, wherein the base member defines a female drive through the bottom surface of the base member, wherein the base member defines a pair of radial through holes that extend through the side wall of the base member to the female drive and are coaxial with one another, wherein the side wall of the base member defines a groove into which both of the radial through holes are located, and further comprising a spring-loaded detent carried by the male drive and located such that a portion of the spring-loaded detent extends through the side wall surface of the male drive.

7. The wrench adapter as set forth in claim 1, wherein the male drive has four side wall surfaces, wherein the body has four concave transition surfaces with upper ends that are flush with the side wall surfaces of the male drive such that smooth transitions are present from the side wall surfaces of the male drive to the concave transition surfaces across the upper ends of the concave transition surfaces;

wherein the body has four recess surfaces that are defined in the top surface of the base member, wherein upper ends of the recess surfaces are flush with bottom ends of the concave transition surfaces such that a smooth transition is present from the concave transition surfaces to the recess surfaces across the upper ends of the recess surfaces, and wherein lower ends of the recess surfaces are not flush with the top surface of the base member such that smooth transitions are not present from the recess surfaces to the top surface of the base member across the lower ends of the recess surfaces;

wherein the male drive has four corners that each have a planar corner surface, wherein the body has four corner transition surfaces with upper ends that are flush with the planar corner surfaces such that smooth transitions are present from the planar corner surfaces to the corner transition surfaces across the upper ends of the corner transition surfaces; and wherein the corner transition surfaces are located between the concave transition surfaces.

8. The wrench adapter as set forth in claim 1, wherein the body is configured for use with an impact wrench.

9. A wrench adapter, comprising:

a body having a base member that has a bottom surface and a top surface, wherein the body has a male drive that is square shaped, wherein the male drive has a side wall surface, wherein the body has a concave transition surface with an upper end that is flush with the side wall surface of the male drive such that a smooth transition is present from the side wall surface of the male drive to the concave transition surface across the upper end of the concave transition surface;

wherein the male drive has a corner that has a planar corner surface, wherein the body has a corner transition surface with an upper end that is flush with the planar corner surface such that a smooth transition is present from the planar corner surface to the corner transition surface across the upper end of the corner transition surface;

wherein the corner transition surface is a curved surface that has a radius of curvature that is different than the radius of curvature of the concave transition surface, wherein the width of the corner transition surface increases in the direction away from the planar corner surface, and wherein the lower end of the corner transition surface is not flush with the top surface of the base member such that a smooth transition is not present from the corner transition surface to the top surface of the base member across the lower end of the corner transition surface.

10. A wrench adapter, comprising:

a body having a base member that has a bottom surface, a top surface, and a side wall, wherein the top surface extends from an upper edge of the side wall, wherein the base member defines a female drive, wherein the body has a male drive that extends in the longitudinal direction and has a longitudinal mid-point, and wherein all of the flat surfaces of the body that are located between the upper edge of the side wall and the longitudinal mid-point of the male drive have surface normals that have a radial component with respect to a longitudinal axis of the body;

wherein the male drive has a first side wall surface and a second side wall surface and a corner surface located between the first side wall surface and the second side wall surface, wherein a corner transition surface extends from the corner surface and has a concave shape, wherein the corner transition surface terminates at a lower end that is spaced from the upper edge of the side wall such that a portion of the top surface is located between the upper edge of the side wall and the lower end of the corner transition surface;

wherein the body has concave transition surface that extends from the first side wall surface and has a concave shape, wherein the concave transition surface has a radius of curvature that is different than the radius of curvature of the corner transition surface, and wherein the lower end of the corner transition surface is not flush with the top surface of the base member such that a smooth transition is not present from the corner transition surface to the top surface of the base member across the lower end of the corner transition surface.

11. The wrench adapter as set forth in claim 10, wherein the first and second side wall surfaces are flat.

12. The wrench adapter as set forth in claim 10, wherein an upper end of the concave transition surface is flush with the first side wall surface of the male drive such that a smooth transition is present from the first side wall surface of the male drive to the concave transition surface across the upper end of the concave transition surface.

13. The wrench adapter as set forth in claim 12, wherein the body has a recess surface that is defined in the top surface of the base member, wherein the upper end of the recess surface is flush with the bottom end of the concave transition surface such that a smooth transition is present from the concave transition surface to the recess surface across the upper end of the recess surface, and wherein the lower end of the recess surface is not flush with the top surface of the base member such that a smooth transition is not present from the recess surface to the top surface of the base member across the lower end of the recess surface.

14. The wrench adapter as set forth in claim 10, wherein the body is made of chrome vanadium steel, wherein the male drive is square shaped and has a third side wall surface and a fourth side wall surface and wherein the first, second, third, and fourth side wall surfaces are flat, wherein the corner surface is planar, wherein the male drive has a second planar corner surface, a third planar corner surface, and a fourth planar corner surface, wherein the female drive is square shaped with rounded corners.

15. The wrench adapter as set forth in claim 10, wherein the body has multiple surfaces that engage the male drive, and wherein all of the multiple surfaces of the body that engage the male drive are concave.

16. A wrench adapter, comprising:

a body having a base member that has a top surface, wherein the body has a male drive that extends in the longitudinal direction, wherein the male drive has a side wall, wherein the body has a concave transition surface that contacts the side wall of the male drive, wherein the body has a side wall and wherein the side wall has an upper edge;

wherein the body has a recess surface that is defined in the top surface of the base member, wherein the recess surface has a width that increases as the recess surface extends away from the concave transition surface to reach a maximum width location and then narrows as the recess surface extends away from the maximum width location in the direction away from the concave transition surface;

wherein the male drive has a corner that has a corner surface, wherein the body has a corner transition surface with an upper end that is flush with the corner surface such that a smooth transition is present from the corner surface to the corner transition surface across the upper end of the corner transition surface;

wherein the lower end of the corner transition surface is not flush with the top surface of the base member such that a smooth transition is not present from the corner transition surface to the top surface of the base member across the lower end of the corner transition surface, and wherein the lower end of the corner transition surface is spaced from the upper edge of the side wall.

17. The wrench adapter as set forth in claim 16, wherein the male drive has a second corner, and wherein the side wall of the male drive extends between the first corner and second corner of the male drive, wherein the corner surface of the first corner is planar and wherein the second corner has a corner surface that is planar, and wherein the concave transition surface does not contact the planar corner surfaces of the first and second corners.

18. The wrench adapter as set forth in claim 16, wherein the top surface of the base member extends towards a longitudinal axis in the direction from the side wall of the body towards the male drive.

19. The wrench adapter as set forth in claim 16, further comprising a spring-loaded detent carried by the male drive and located such that a portion of the spring-loaded detent extends through the side wall of the male drive, and wherein the body is made of chrome vanadium steel, and wherein the base member has a bottom surface, and wherein the base member defines a female drive that extends through the bottom surface of the base member.

20. A wrench adapter, comprising:

a body having a base member that has a top surface, wherein the body has a male drive that extends in the longitudinal direction, wherein the male drive has a side wall, wherein the body has a concave transition surface that contacts the side wall of the male drive;

wherein the male drive has four side wall surfaces, wherein the body has four concave transition surfaces such that each one of the concave transition surfaces contacts one of the side wall surfaces;

wherein the body has four recess surfaces that are defined in the top surface of the base member, wherein upper ends of the recess surfaces are flush with the bottom ends of the concave transition surfaces such that a smooth transition is present from the concave transition surfaces to the recess surfaces across the upper ends of the recess surfaces, and wherein the lower ends of the recess surfaces are not flush with the top surface of the base member such that smooth transitions are not present from the recess surfaces to the top surface of the base member across the lower ends of the recess surfaces;

wherein the male drive has four corners that each have a planar corner surface, wherein the body has four corner transition surfaces such that each one of the corner transition surfaces contacts one of the planar corner surfaces;

wherein the four corner transition surfaces are curved surfaces, wherein the radius of curvature of the four corner transition surfaces is different than the radius of curvature of the four concave transition surfaces.

* * * * *